United States Patent [19]

Mishima et al.

[11] Patent Number: 5,032,479

[45] Date of Patent: Jul. 16, 1991

[54] ION TRANSPORT PHOTORECEPTOR FOR ELECTROPHOTOGRAPHY

[75] Inventors: Masayuki Mishima; Harumasa Yamasaki; Takashi Matsuse; Tadashi Sakuma; Hiroyasu Togashi, all of Wakayama, Japan

[73] Assignee: KAO Corporation, Tokyo, Japan

[21] Appl. No.: 366,439

[22] Filed: Jun. 15, 1989

[30] Foreign Application Priority Data

Jun. 21, 1988 [JP] Japan ..... 63-152703

[51] Int. Cl.[5] ..... G03G 15/02

[52] U.S. Cl. ..... 430/58

[58] Field of Search ..... 430/58, 59, 85

[56] References Cited

U.S. PATENT DOCUMENTS 3,837,851 9/1974 Shattuck et al. ..... 430/58

4,088,484 5/1978 Okazaki et al. ..... 430/58

*Primary Examiner*—John Goodrow

*Attorney, Agent, or Firm*—Birch, Stewart, Kolasch & Birch

[57] ABSTRACT

A photoreceptor useful for electrophotography and comprises (a) an electrically conductive substrate, (b) an electric charge carrier generation layer and (c) an electric charge carrier transport layer containing therein an electric charge carrier transport compound having the formula (1):

(1)

in which $R_1$, $R_1'$ and $R_1''$ each are hydrogen, a linear or branched alkyl, a linear or branched alkyl having a substituent(s), an aryl or an aryl having a substituent(s), $R_2$, $R_3$, $R_2'$, $R_3'$, $R_2''$ and $R_3''$ each are hydrogen, a linear or branched alkyl, a linear or branched alkyl having a substituent(s), an aryl, an aryl having a substituent(s), an alkenyl, an alkenyl having a substituent(s), a heterocyclic ring or a heterocyclic ring having a substituent(s), $R_2$ and $R_3$ may form a ring with their adjacent carbon, $R_2'$ and $R_3'$ may form a ring with their adjacent carbon and $R_2''$ and $R_3''$ may form a ring with their adjacent carbon and, A is a trivalent, aromatic hydrocarbon group.

4 Claims, 1 Drawing Sheet

ION TRANSPORT PHOTORECEPTOR FOR ELECTROPHOTOGRAPHY

BACKGROUND OF THE INVENTION

1. Field of the Invention

The invention relates to a photoreceptor for use in electrophotography and more specifically to an improved photoreceptor having a high sensitivity and a high endurance by incorporation of a specified compound in the electric charge carrier transport layer.

2. Prior Art

Recent development of electrophotographic copying machines and printers is so remarkable that various kinds of machines and printers have been developed, accompanied with the development of many kinds of photoreceptors suitable for use with them.

Until recently inorganic compounds have been mainly used as electrophotographic photoreceptors from the standpoint of sensitivity and endurance. Such inorganic compounds include zinc oxide, cadmium sulfide and selenium. However, most of the inorganic electrophotographic photoreceptors according to the prior art contain health hazardous materials, so that the disposal thereof is a problem and causes environmental pollution. Further, when selenium, excellent in sensitivity, is used, a thin film thereof must be formed on a conductive support by vapor deposition or the like, which brings about a lowering in the productivity and an increase in the cost. Recently, an amorphous silicon photoreceptor has been noted as being a harmless inorganic photoreceptor and further study regarding this photoreceptor is now in progress. However, such an amorphous silicon photoreceptor is disadvantageous in that a thin film of amorphous silicon must be formed, mainly by plasma CVD, so that the productivity thereof is very low and, not only is the material cost high but, also, the running cost is high, although the resulting photoreceptor is excellent in sensitivity.

Meanwhile, an organic photoreceptor has advantages in that it does not cause environmental pollution because of its disposability by fire, such that the formation of a thin film can be carried out by coating in many cases to permit the mass-production of a photoreceptor at a remarkably lowered cost and such a photoreceptor can be fabricated into various shapes, depending upon the use. However, the organic photoreceptor is still a problem both as to in sensitivity and endurance, so that it is necessary to develop a high-sensitivity and high-endurance organic photoreceptor.

Although various methods have been proposed for improving the sensitivity of an organic photoreceptor, a separate type of the photoreceptor having a double-layered structure comprising a generator layer and a transport layer now prevails. For example, electric charges generated by exposure in the generator layer are injected into the transport layer and pass through it to reach the surface of the photoreceptor, where they neutralize the surface charge to form an electrostatic latent image on the surface. This type of photoreceptor is characterized in that the generated charge carriers are trapped in less probability than in a single-layered structure, so that no damage is done to the function of each layer to permit the efficient transport of the charges to the surface (see U.S. Pat. No. 2,803,541).

The organic charge generating agent to be used in the generator layer is selected from compounds which can absorb the energy of radiation to generate electric charges efficiently. Examples of such compounds include azo pigments (see Japanese Patent Laid-Open No. 14967/1979), metallophthalocyanine pigments (see Japanese Patent Laid-Open No. 143346/1985), metal-containing phthalocyanin pigments (see Japanese Patent Laid-Open No. 16538/1975) and squarylium salts (see Japanese Patent Laid-Open No. 27033/1978)

The charge transporting agent to be used in the transport layer must be selected from compounds into which electric charge can be injected from a generator layer with high efficiency and the transport layer is one in which the electric charge can move freely That is, it is suitable to use a compound which has a low ionization potential or generates a radical cation easily. Examples of the compound which has been proposed as the charge transporting agent include triarylamine derivatives (see Japanese Patent Laid-Open No. 47260/1978), hydrazone derivatives (see Japanese Patent Laid-Open No. 101844/1982), oxadiazole derivatives (see Japanese Patent Publication No. 5466/1959), pyrazoline derivatives (see Japanese Patent Publication No. 4188/1977), stilbene derivatives (see Japanese patent publication A No. 198043/1983), triphenylmethane derivatives (see Japanese patent publication B 45-555) and a tristyrylamine (see Japanese patent publication A No. 62-264058).

However, these organic charge transporting agents are inferior to inorganic ones in charge carrier mobility and are unsatisfactory in sensitivity as well.

Since an electrophotographic photoreceptor is exposed to extremely severe conditions in the series of electrophotographic process steps comprising charging, exposure, development, transfer and erasing, the resistance thereof to ozone and abrasion are especially important factors. Therefore, it is necessary that the materials to be used in a photoreceptor be excellent in the resistance. Further, the development of the binder and protective layer to be used in a photoreceptor are also in under investigation. However, no satisfactory photoreceptor has been developed as yet.

SUMMARY OF THE INVENTION

The present invention has been developed for the purpose of overcoming the above problems to obtain a high-endurance electrophotographic photoreceptor and an electrophotographic photoreceptor containing a specified compound in its transport layer has been found having excellent sensitivity and endurance. The present invention has been accomplished on the basis of this finding.

The photoreceptor of the present invention is useful for electrophotography and comprises (a) an electrically conductive substrate, (b) an electric charge carrier generation layer and (c) an electric charge carrier transport layer containing therein an electric charge carrier transport compound having the formula (1):

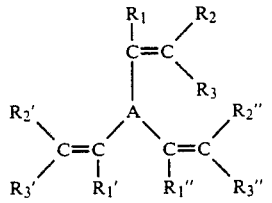

(1)

in which $R_1$, $R_1'$ and $R_1''$ each are hydrogen, a linear or branched alkyl, a linear or branched alkyl having a substituent(s), an aryl or an aryl having a substituent(s), $R_2$, $R_3$, $R_2'$, $R_3'$, $R_2''$ and $R_3''$ each are hydrogen, a linear or branched alkyl, a linear or branched alkyl having a substituent(s), an aryl, an aryl having a substituent(s), an alkenyl, an alkenyl having a substituent(s), a heterocyclic ring or a heterocyclic ring having a substituent(s), $R_2$ and $R_3$ may form a ring with their adjacent carbon, $R_2'$ and $R_3'$ may form a ring with their adjacent carbon and $R_2''$ and $R_3''$ may form a ring with their adjacent carbon, A is a trivalent, aromatic hydrocarbon group.

It is preferable that the aromatic hydrocarbon group for A is selected from

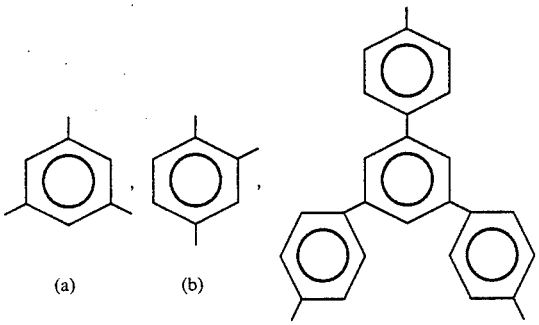

(a) (b) (c)

(d) naphthalene, (e) anthrathene, (f) phenanthrene, (g) pyrene, (h) naphthathene, (i) 1,2-benzoanthrathene, (j) 3,4-benzophenanthrene, (k) chrysene and (1) triphenylene. In particular, groups (a) and (b) are more preferable.

It is further preferable that $R_1$, $R_1'$ and $R_1''$ each are hydrogen, an alkyl having 1 to 6 carbon atoms, phenyl or naphthyl; and $R_2$, $R_2'$, $R_2''$, $R_3$, $R_3'$ and $R_3''$ each are hydrogen, an alkyl having 1 to 12 carbon atoms, phenyl, naphthyl or styryl; or $R_2$ and $R_3$, $R_2'$ and $R_3'$ and/or $R_2''$ and $R_3''$ may form a ring having 4 to 12 carbon atoms.

The invention provides a novel compound having the above shown formula (1) in which the aromatic hydrocarbon group for A is (b).

In the specification, (a) the electrically conductive substrate is called also an electrically conductive supporting substrate, (b) the electric charge carrier generation layer is called also an electron-generating layer, (c) the electric charge carrier transport layer is called also an electron-transporting layer, and the electric charge carrier transport compound is called, also, an electron-transporting compound In the general formula (1), $R_1$, $R_1'$ and $R_1''$ may be the same or different from each other and each stand for a hydrogen atom, a straight-chain or branched alkyl group which may be substituted or an aryl group which may be substituted. They are each preferably a hydrogen atom, an alkyl group having 1 to 6 carbon atoms or an aryl group from the standpoint of ease of preparation and performance of the resulting compound. Examples of the alkyl and aryl groups include methyl, ethyl and phenyl groups.

In the general formula (1), $R_2$, $R_2$, $R_2'$, $R_3'$, $R_2''$ and $R_3''$ may be the same or different from each other and each stand for a hydrogen atom, a straight-chain or branched alkyl group which may be substituted, an aryl group which may be substituted, an alkenyl group which may be substituted or a heterocyclic group which may be substituted. Alternatively, $R_2$ and $R_3$ and/or $R_2''$ and $R_3'$ and/or $R_2''$ and $R_3''$ may form a ring together with their adjacent carbon atom.

Preferable among them are alkyl groups having 1 to 12 carbon atoms, aryl, alkenyl and heterocyclic groups and those groups which form a ring having 4 to 12 carbon atoms together with their adjacent carbon atom.

Examples of the alkyl, aryl and heterocyclic groups include methyl, ethyl, phenyl and naphthyl groups and substituted derivatives thereof, while those of the alkenyl group include

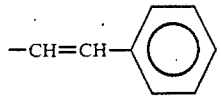

and substituted derivatives thereof.

Although the process for preparing the trifunctional compound according to the present invention is not particularly limited, the compound may be prepared by a conventional process for the preparation of styryl compounds. For example, it may be prepared by the condensation of a triacylated A with triphenylphosphonium halide or phosphonate or by the condensation of a carbonyl compound with

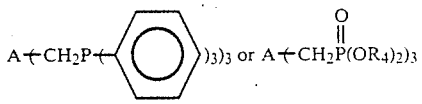

wherein $R_4$ is a lower alkyl group.

Although the three groups bonded to the trivalent group A may be identical, a trifunctional compound having three groups different from each other may be prepared by selecting raw materials arbitrarily.

Although an electrophotographic photoreceptor containing a tristyryl compound has been proposed in Japanese Patent Laid-Open No. 264058/1987, the triphenylamine derivative disclosed therein is disadvantageous in that it is difficult to prepare a triformylated triphenylamine which is a raw material for the preparation of the derivative. The trifunctional compound to be used in the present invention is easily prepared and the performance thereof as a photoreceptor is improved as compared with the one of the above triphenylamine derivative. Accordingly, the electrophotographic photoreceptor is superior to the one described above.

Examples of the trifunctional compound to be used in the present invention, while not limited thereto, are as follows:

(2)
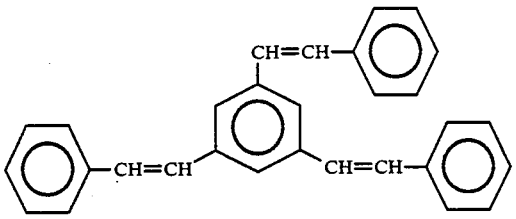
(3)
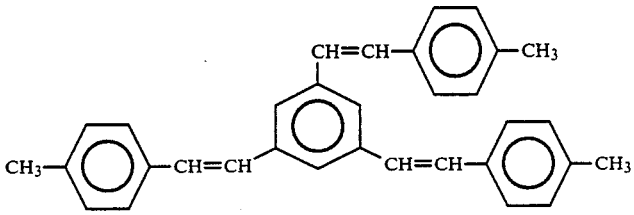
(4)
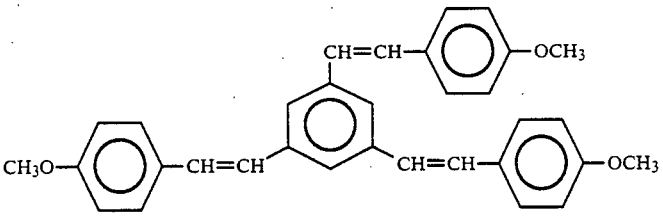
(5)
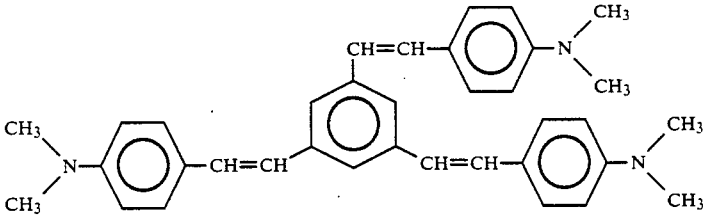
(6)
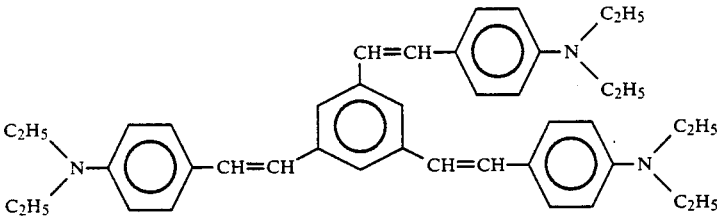
(7)
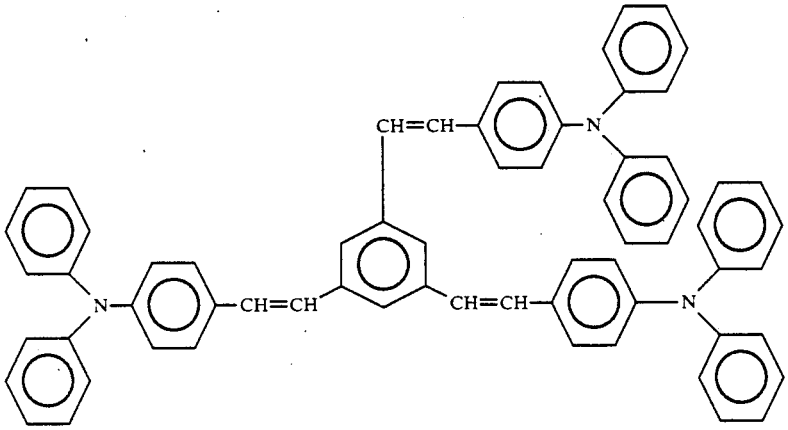

-continued
(8)
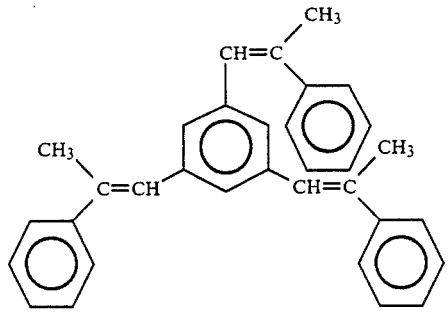
(9)
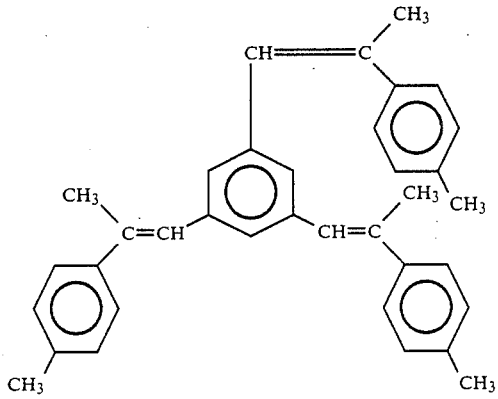
(10)
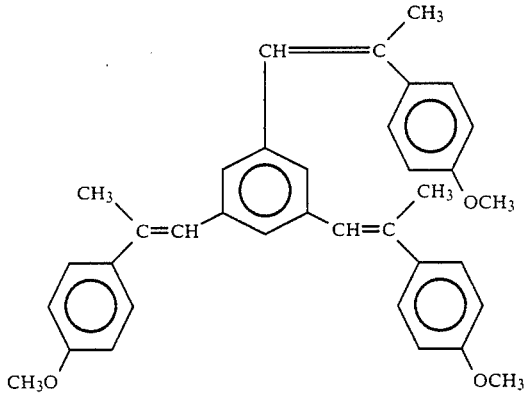
(11)
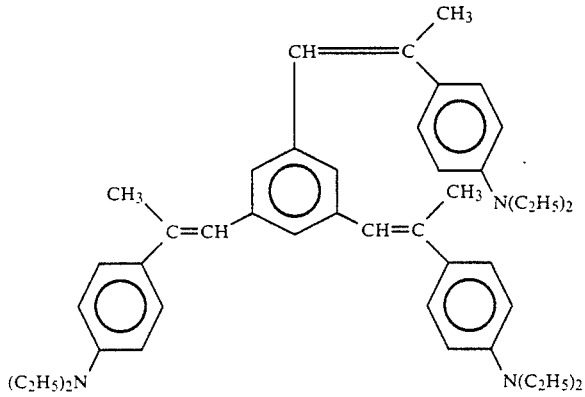

-continued
(12)
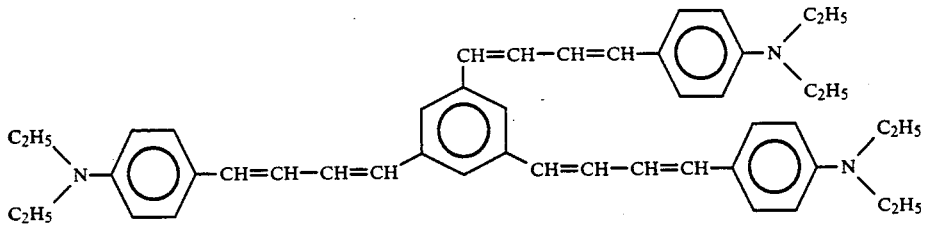
(13)
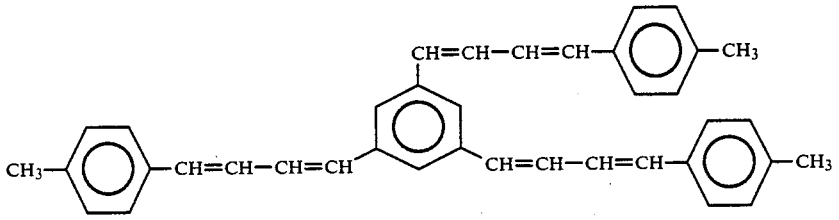
(14)
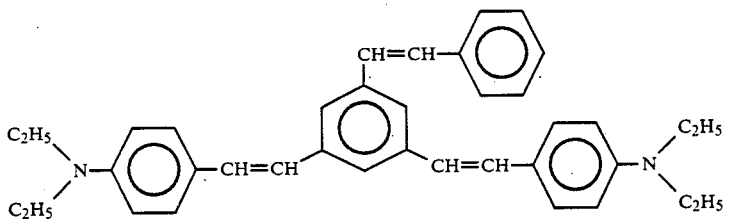
(15)
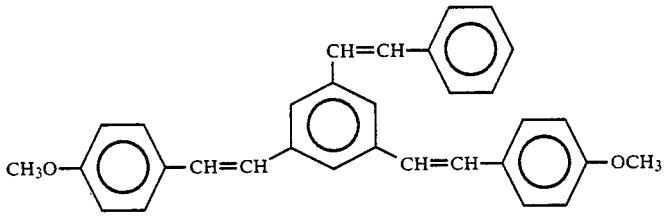
(16)
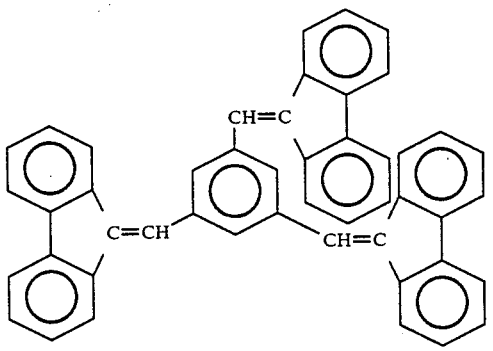
(17)
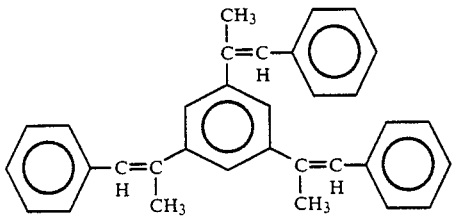

-continued
(18)
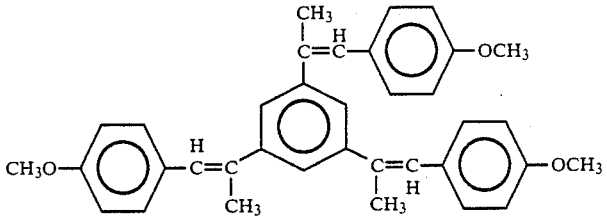
(19)
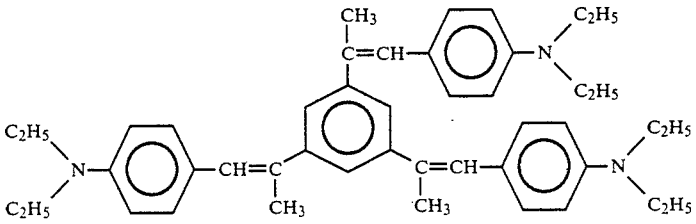
(20)
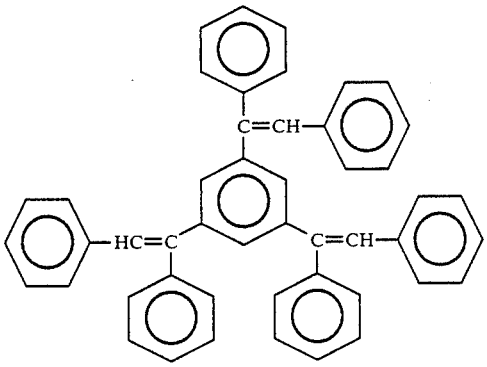
(21)
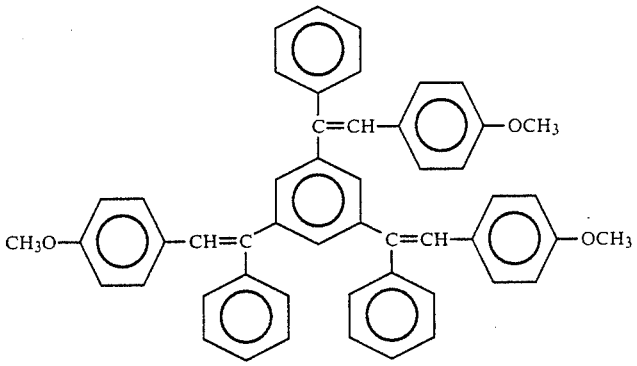
(22)
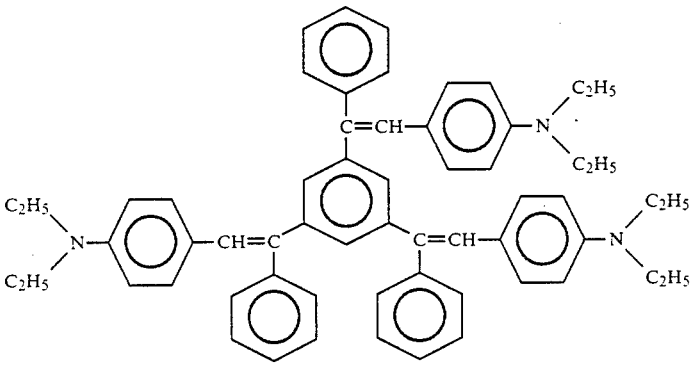

-continued
(23)
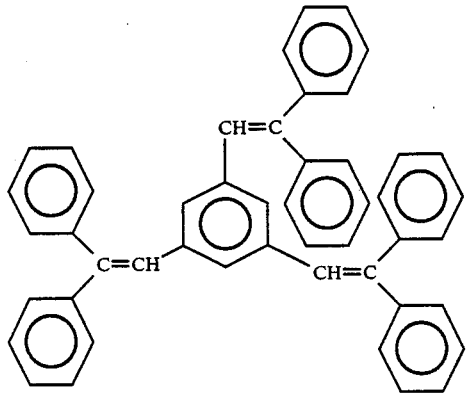
(24)
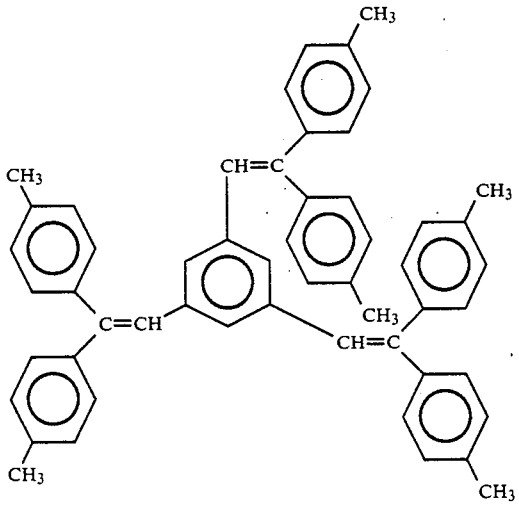
(25)
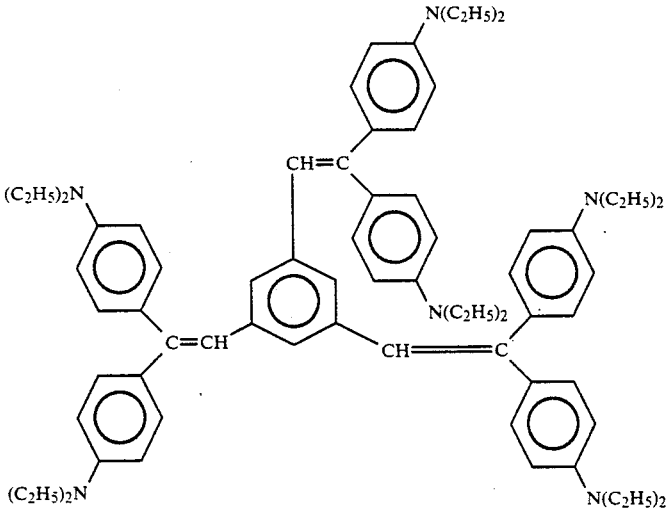
(26)
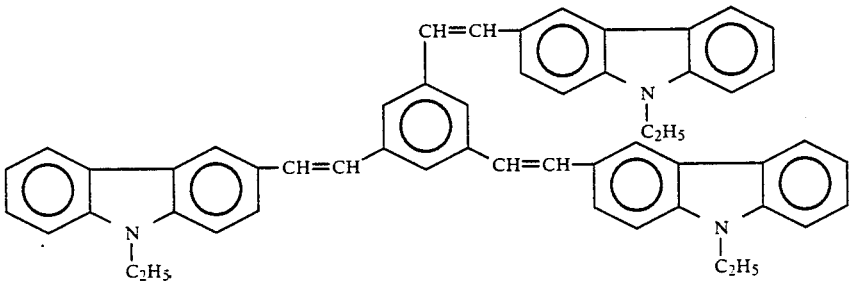

-continued
(27)
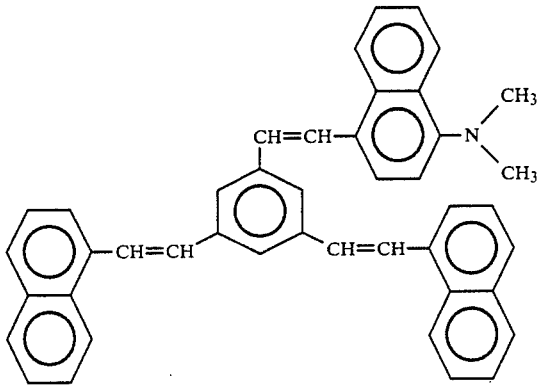
(28)
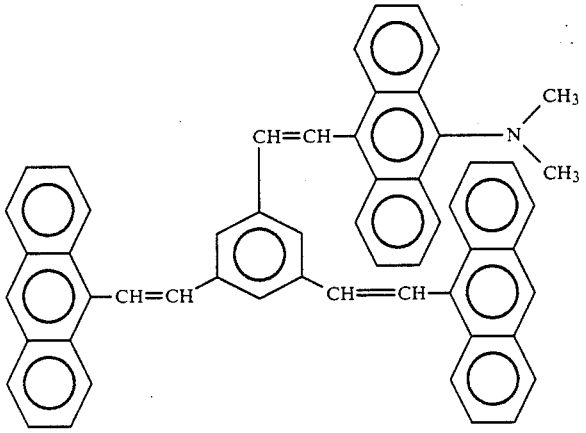
(29)
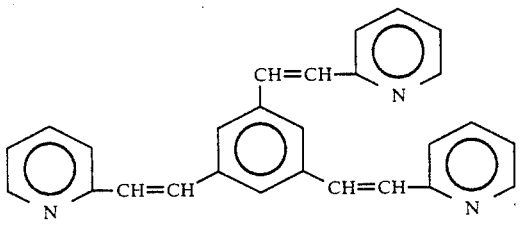
(30)
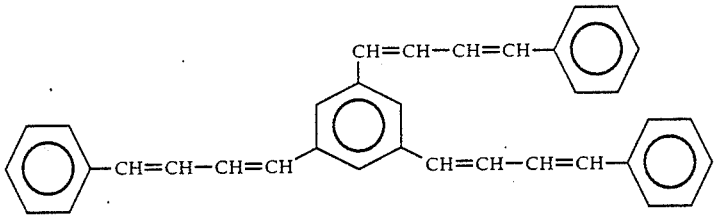
(31)
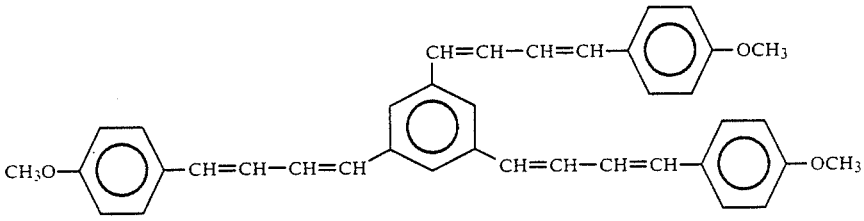

-continued
(32)
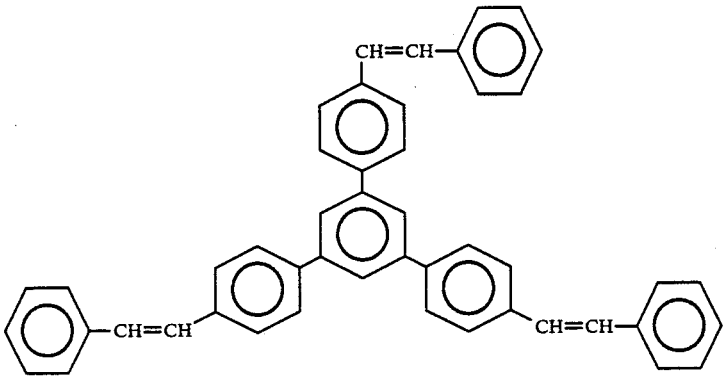
(33)
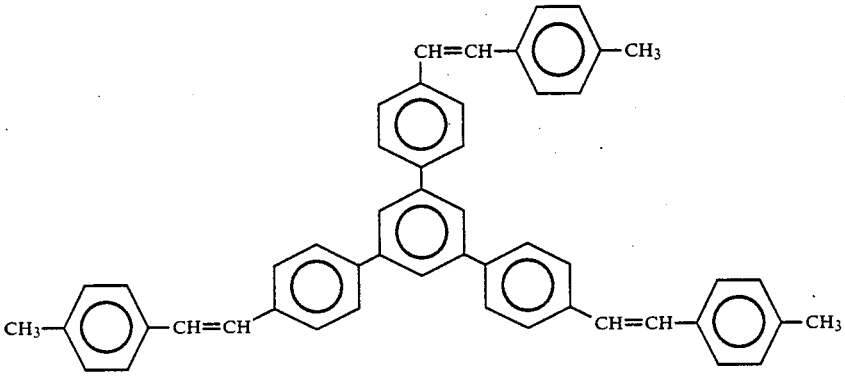
(34)
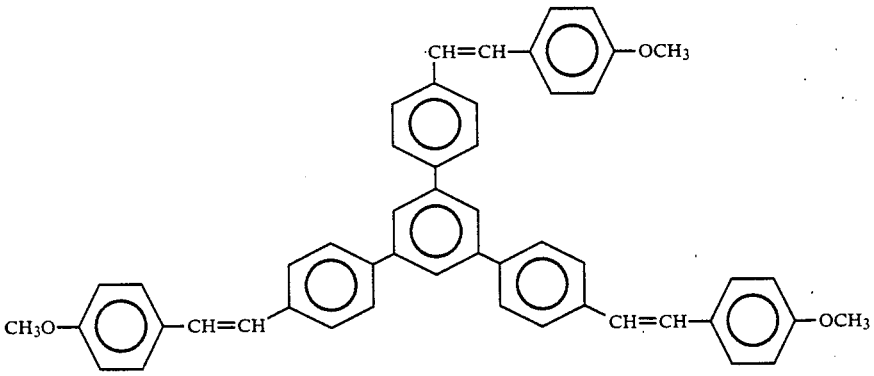
(35)
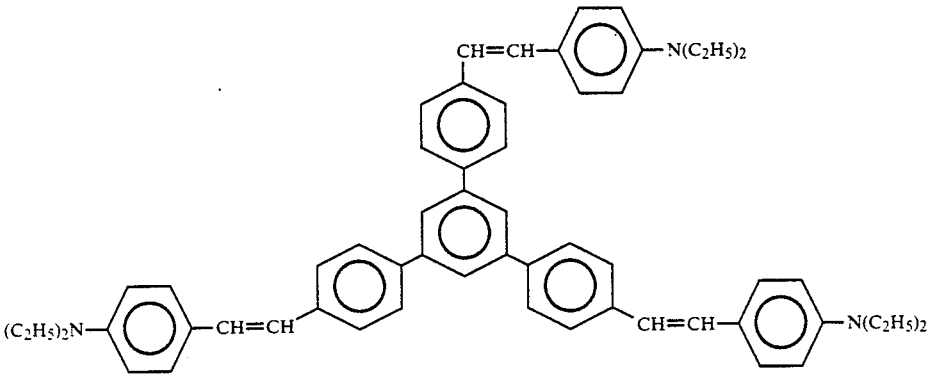

-continued
(36)
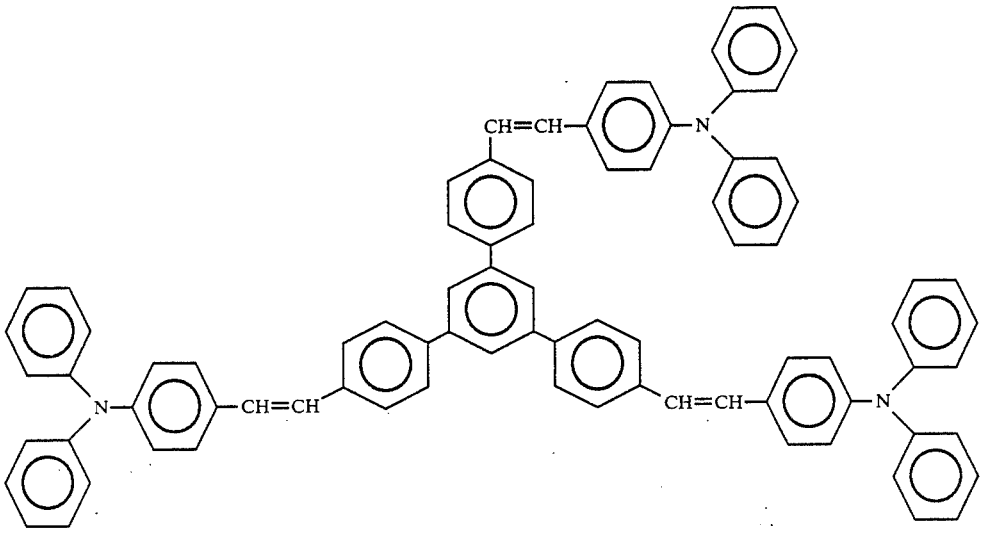
(37)
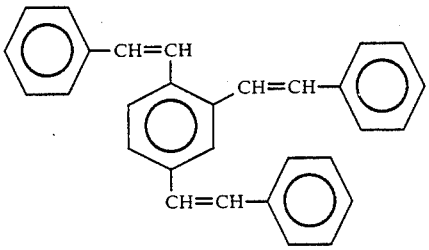
(38)
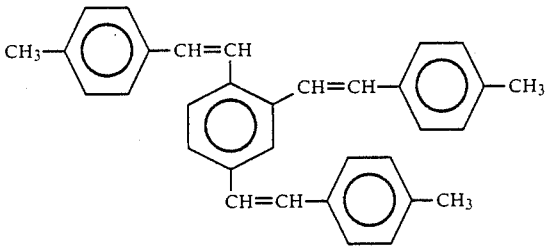
(39)
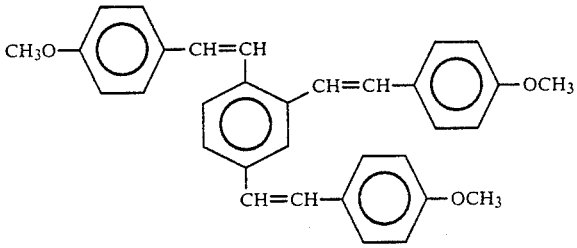
(40)
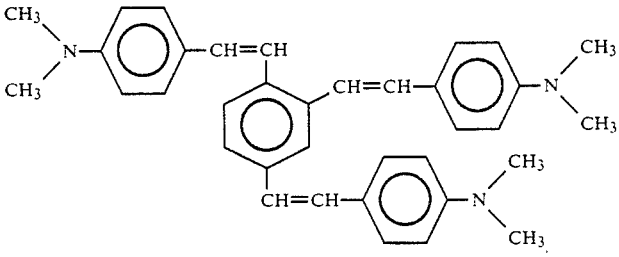

-continued
(41)
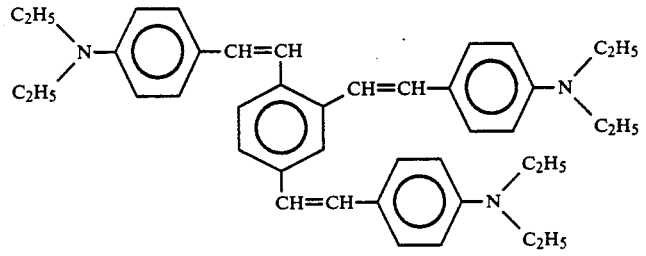
(42)
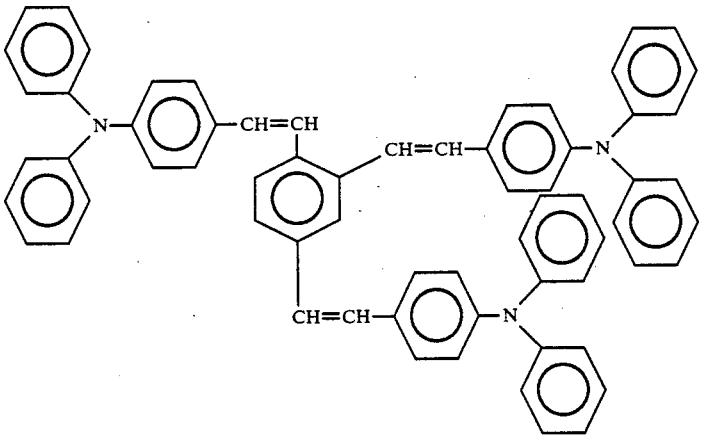
(43)
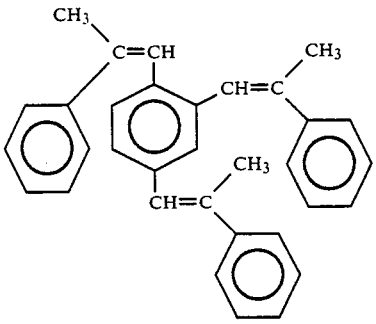
(44)
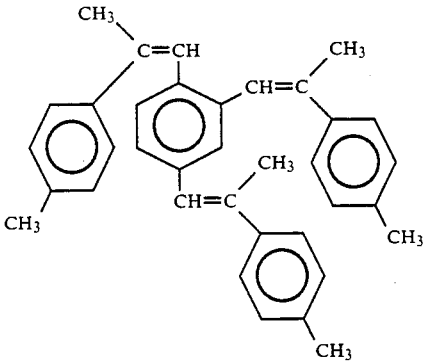

-continued
(45)
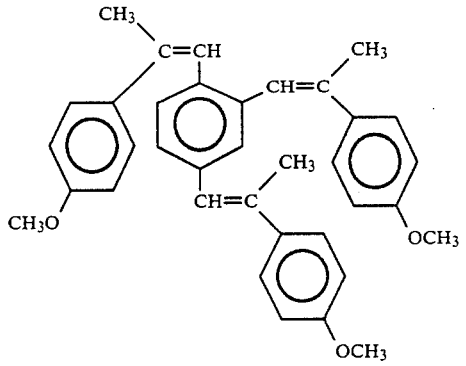
(46)
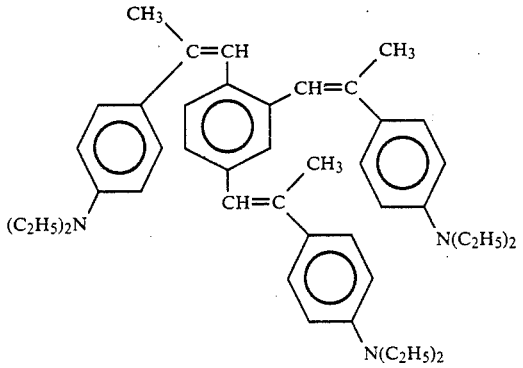
(47)
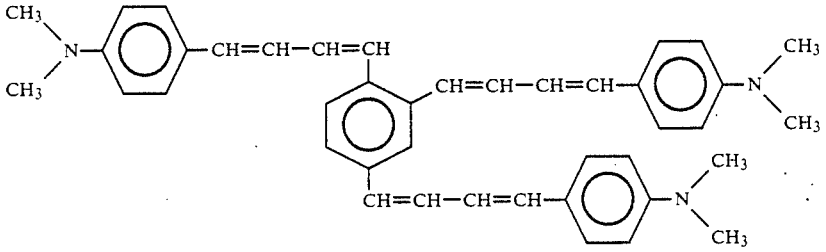
(48)
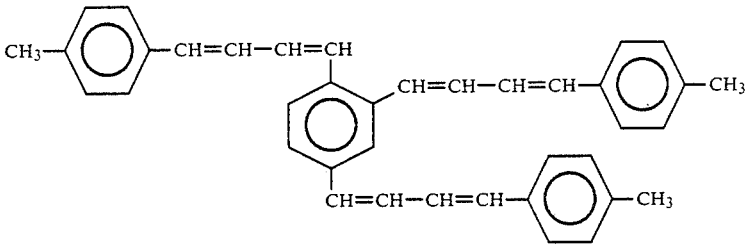
(49)
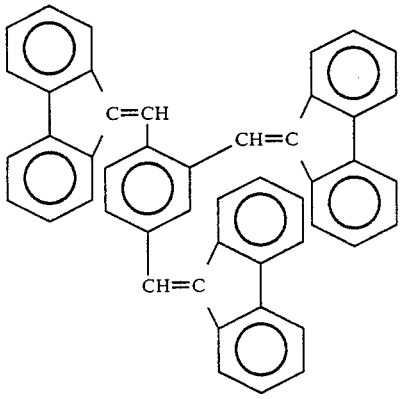

-continued
(50)
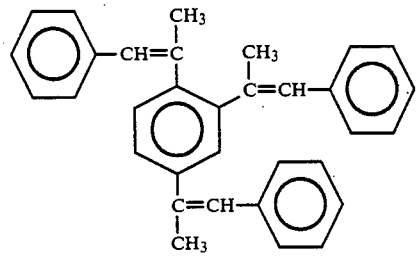
(51)
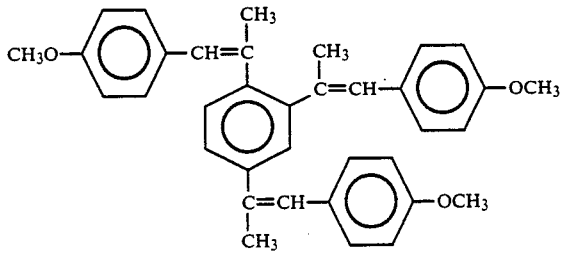
(52)
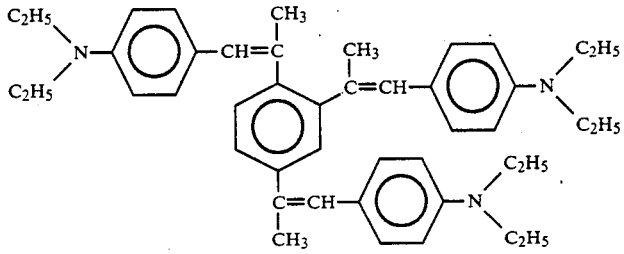
(53)
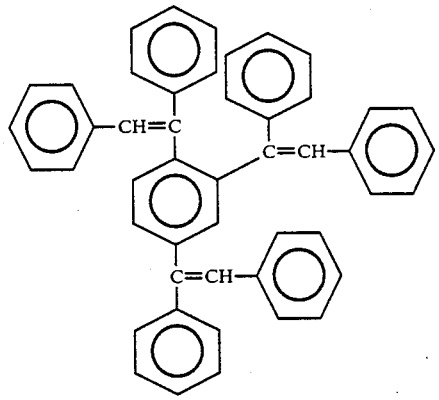
(54)
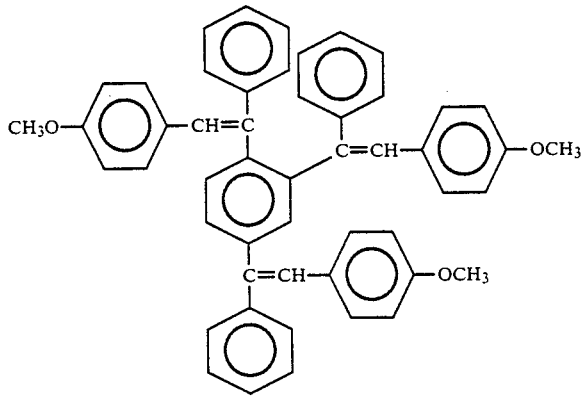

-continued
(55)
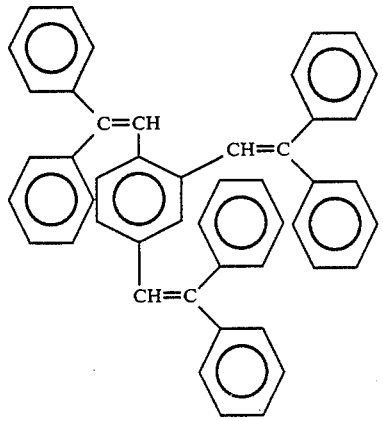
(56)
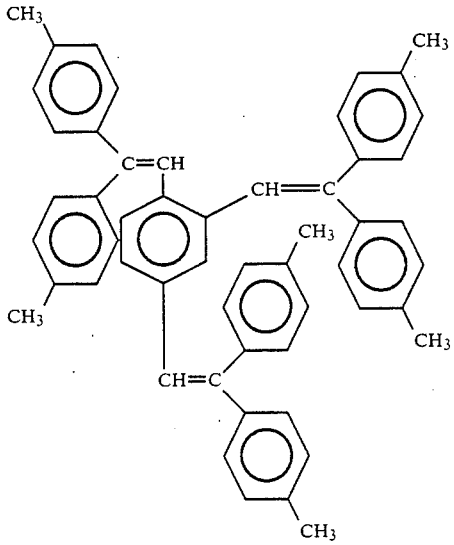
(57)
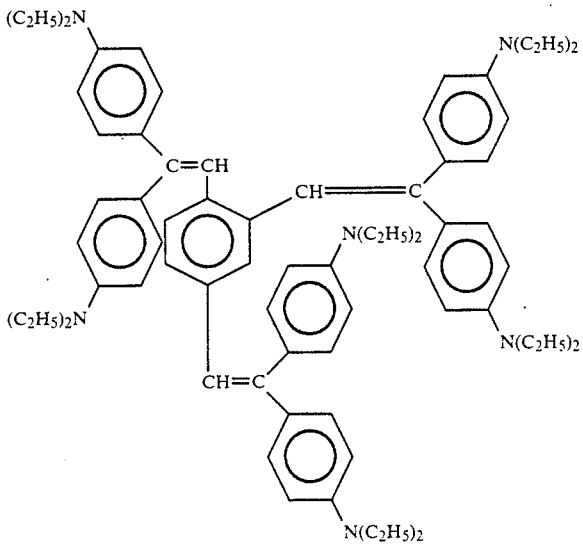

-continued
(58)
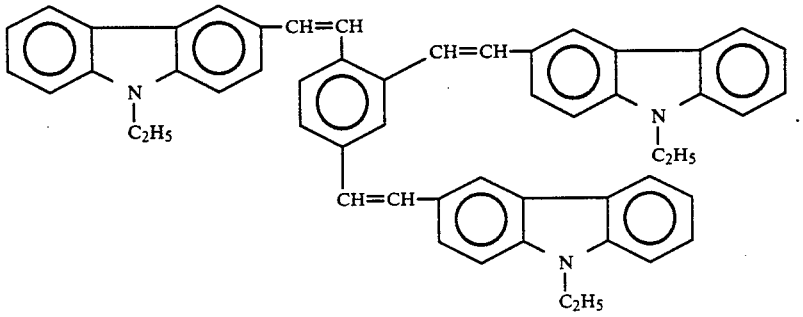
(59)
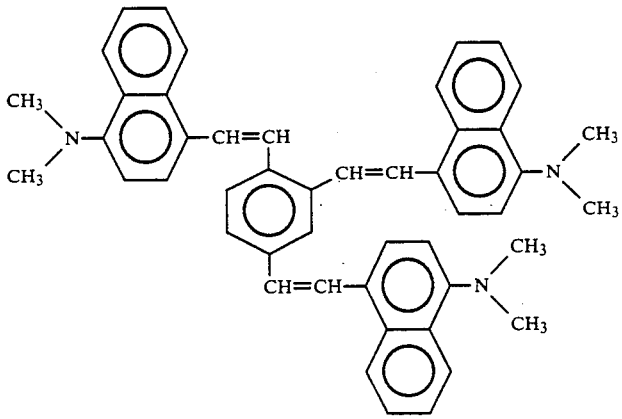
(60)
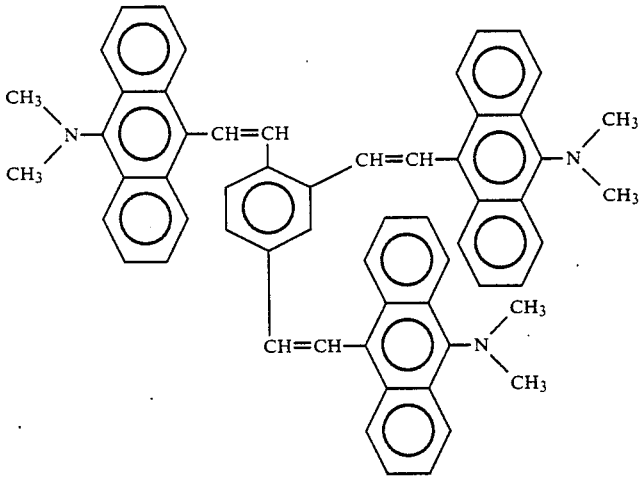
(61)
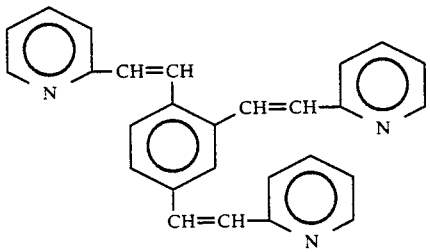

-continued
(62)
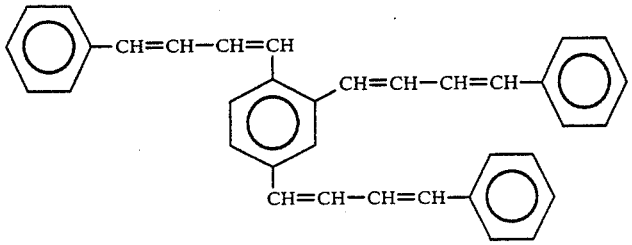
(63)
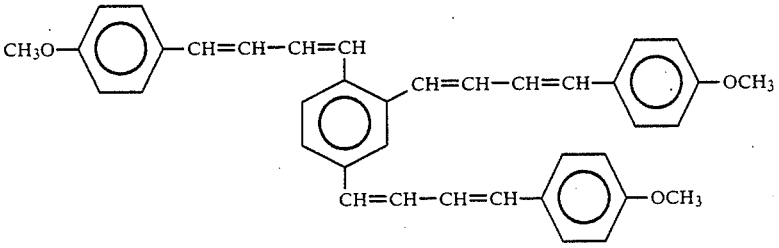
(64)
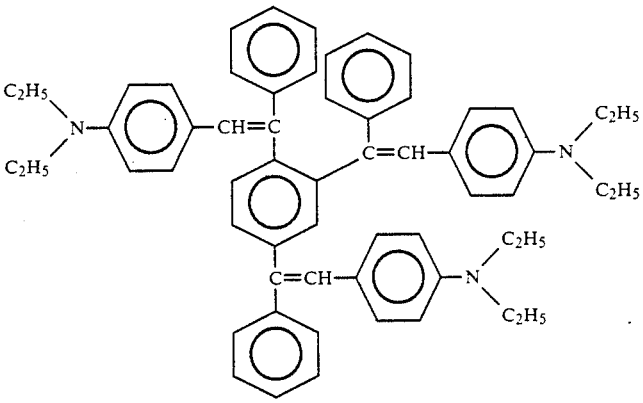
(65)
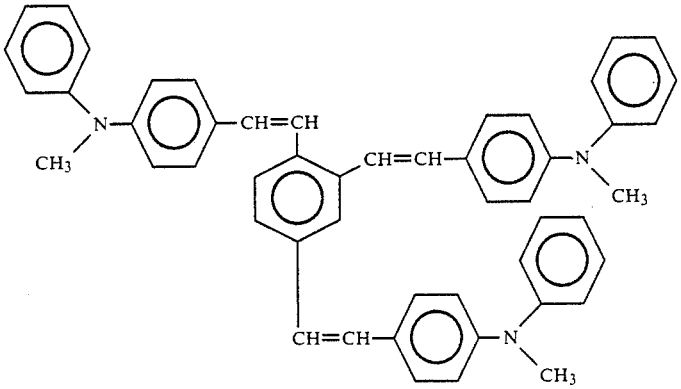

-continued (66)

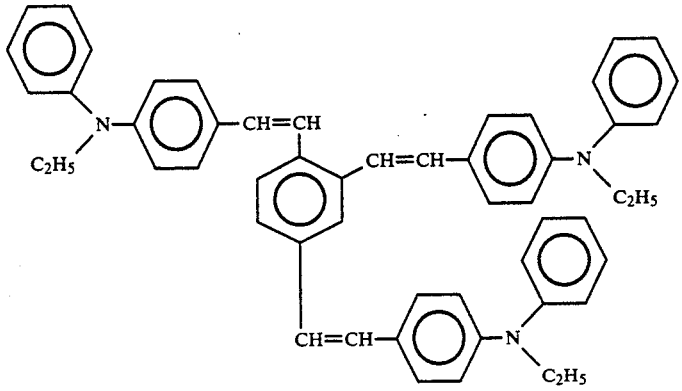

(67)

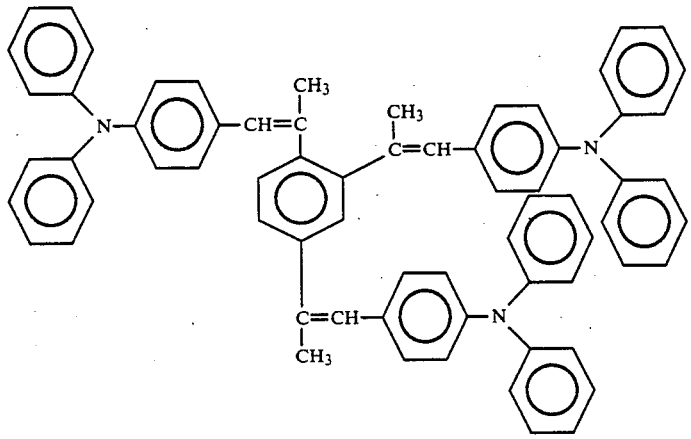

According to the present invention, these compounds may be used alone or as a mixture of two or more of them.

The above compounds are soluble in many solvents. Examples thereof in which they are soluble include aromatic solvents such as benzene, toluene, xylene, tetralin and chlorobenzene; halogenated solvents such as dichloromethane, chloroform, trichloroethylene and tetrachloroethylene; ester solvents such as methyl acetate, ethyl acetate, propyl acetate, methyl formate and ethyl formate; ketone solvents such as acetone and methyl ethyl ketone; ether solvents such as diethyl ether, dipropyl ether and tetrahydrofuran; alcohol solvents such as methanol, ethanol and isopropyl alcohol; dimethylformamide, dimethylacetamide and dimethyl sulfoxide.

The electrophotographic photoreceptor according to the present invention may be produced by forming a generator layer and a transport layer each in the form a thin film on a conductive substrate. The conductive substrate includes metals such as aluminum and nickel, metallized polymer films and laminates comprising a polymer film and metal It may be in the form of a drum or sheet.

The generator layer comprises a charge generating agent and, if necessary, a polymer binder and additives and may be prepared by vacuum deposition, plasma CVD or coating.

The charge generating agent is not particularly limited, but may be any organic or inorganic compound which is sensitive to radiation of a specified wavelength to generate electric charges efficiently.

The organic charge generating agent includes perylene pigments, polycyclic quinone pigments, metal-free phthalocyanine pigments, metallophthalocyanine pigments, bisazo pigments, trisazo pigments, thiapyrylium salts, squarylium salts and azulenium pigments. These materials may be each dispersed in a polymer binder and applied by coating to form a generator layer. The inorganic charge generating agent includes selenium, its alloys, cadmium sulfide, zinc oxide and amorphous silicon.

It is preferable that the generator layer have a thickness of 0.1 to 2.0 μm, still preferably 0.2 to 1.0 μm.

Then, a transport layer containing a trifunctional compound represented by the general formula (1) is formed in the form of a thin film on the generator layer discussed above. The formation of the transport layer is generally carried out by coating. That is, a trifunctional compound represented by the general formula (1), if necessary, together with a polymer binder, are dissolved in a solvent and the resulting solution is applied on the generator layer and dried.

The solvent to be used in the preparation of the solution is not particularly limited, but may be any one in which the trifunctional compound and the polymer binder are soluble and the generator layer is isouble.

The polymer binder to be used as required is not particularly limited, as far as it is an electrical insulating resin. Examples thereof include condensation polymers such as polycarbonate, polyarylate, polyester and polyamide; addition polymers such as polyethylene, polystyrene, styrene-acrylate copolymer, polyacrylate, polymethacrylate, polyvinyl butyral, polyacrylonitrile, polyacrylamide, acrylonitrile-butadiene copolymer and polyvinyl chloride; polysulfone, polyether sulfone and silicone resin. These resins may be used alone or as a mixture of two or more of them.

The weight ratio of the polymer binder to the compound represented by the general formula (1) is 0.1 to 3, preferably 0.1 to 2. When the amount of the polymer binder exceeds this upper limit, the concentration of the charge transporting agent in the obtained transport layer will be too low to attain excellent sensitivity.

According to the present invention, if necessary, a conventional charge transporting agent, as described above, may be used together with the trifunctional compound in this invention.

The means for forming a transport layer are not limited, but the layer may be formed with a bar coater, calender coater, gravure coater, blade coater, spin coater or dip coater.

The transport layer thus formed has preferably a thickness of 10 to 50 μm, still preferably 10 to 30 μm. When the film thickness exceeds 50 μm, charge carrier transport will take a prolonged time and the charge carrier will be trapped in an enhanced probability to lower the sensitivity. On the contrary, when the thickness is lower than 10 μm, the mechanical strength of the film will be poor to shorten the life of the photoreceptor. Although the electrophotographic photoreceptor containing a compound represented by the general formula (1) in its transport layer can be produced as described above, if necessary, an undercoat layer, an adhesive layer or an interface layer may be formed between the conductive substrate and the generator layer. For example, polyvinyl butyral, phenolic resin or polyamide resin may be used to form these layers. Further, a protective layer may be formed on the surface of the photoreceptor.

In the practical use of the electrophotographic photoreceptor thus produced, the surface of the photoreceptor is first charged negatively with a corona discharger. The resulting photoreceptor is exposed to light to generate electric charges in the generator layer. The positive charges are injected into the transport layer and passed through it to reach the surface of the photoreceptor, thus neutralizing the negative charges on the surface. Meanwhile, the unexposed area is still charged negatively to form an electrostatic latent image. A toner is applied to and adheres to the unexposed area following which the toner is selectively transferred to paper and fixed thereto.

Alternatively, a transport layer may be first formed on a conductive substrate, followed by the formation of a generator layer thereon. In the practical use of the electrophotographic photoreceptor thus obtained, the surface of the photoreceptor is first charged positively. After the exposure, generated negative charges are passed through the transport layer to reach the substrate to form a positively charged electrostatic latent image.

The electrophotographic photoreceptor of the present invention characterized by containing a specified trifunctional compound in its transport layer, exhibits stable initial surface potential, small dark decay and high sensitivity. Further, it is excellent in endurance and only a little deteriorated, even by repeated operation.

As before mentioned, the invention provides a novel compound having the formula (1) in which A is (b).

In other words, the invention provides the styryl compound indicated by the general formula (68) below.

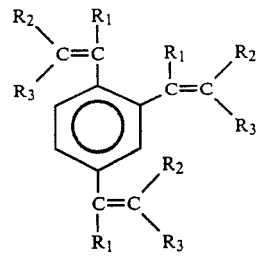

(68)

(In the formula above, $R_1$ represents either hydrogen atoms, alkyl groups or aryl groups, $R_2$ and $R_3$ can be identical or different and represent either hydrogen atoms, alkyl groups which may be substituted, aryl groups which may be substituted, alkenyl groups which may be substituted, or heterocyclic groups which may be substituted, or $R_2$ and $R_3$ form a ring together with the adjacent carbon atom.)

Furthermore, this invention provides the manufacturing method of the styryl compound indicated in general formula (68) above which has the characteristic of reacting the benzene phosphonate ester indicated in general formula (69) and the carbonyl compound indicated in general formula (70).

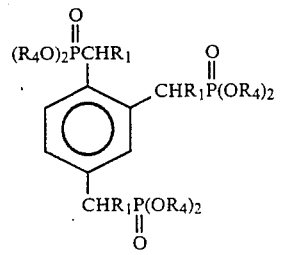

(69)

(In the formula above, $R_1$ are the same as those of general formula (1) above and $R_4$ are lower alkyl groups.)

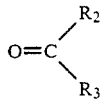

(70)

(In the formula above, $R_2$ and $R_3$ are the same as those of general formula (68) above.)

$R_4$ of the benzene phosphonate ester indicated in general formula (69) are lower alkyl groups having 1–4 carbons with methyl groups and ethyl groups be desirable. This benzene phosphate ester indicated in general formula (69) can be obtained by reacting the trihalogenated compound indicated in general formula (71) with trialkyl phosphorous acid.

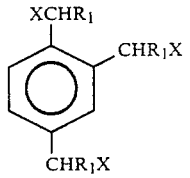

(71)

(In the formula above, $R_1$ are the same as those in general formula (68) above and X represents halogen atoms.)

Here, although $R_1$ represent hydrogen atoms, alkyl groups or aryl groups, hydrogen atoms, methyl groups or phenyl groups are most desirable since these groups facilitate easier manufacturing.

$R_2$ and $R_3$ of the carbonyl compound indicated in general formula (70) may be identical or different and represent hydrogen atoms, alkyl groups which may be substituted, aryl groups which may be substituted, alkenyl groups which may be substituted or heterocyclic groups which may be substituted, or $R_2$ and $R_3$ form a ring together with the adjacent carbon atom. Examples of alkyl groups include methyl groups, ethyl groups and propyl groups, examples of aryl groups include phenyl groups, naphthyl groups and styryl groups, and examples of heterocyclic groups include carbazole groups, indoryl groups and pyridyl groups.

Furthermore, these groups may contain substitutional groups. For example, alkyl groups such as methyl groups and ethyl groups, methoxy groups, and amino groups such as those indicated below are desirable for use as electron donating groups.

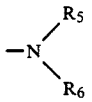

(In the formula above, $R_5$ and $R_6$ may be identical or different, and represent alkyl groups or aryl groups.)

In addition, an example of a case in which $R_2$ and $R_3$ form a ring together with the adjacent carbon atom is when 9-fluorenone is used for the carbonyl group indicated in general formula (70).

Based on the above, the styryl compound indicated in general formula (68) can be obtained by reacting the benzene phosphonate ester indicated in formula (69) with the carbonyl compound indicated in formula (70). The reaction can be carried out in the presence of base in a polar solvent within a temperature range extending from room temperature to the boiling point of the solvent.

Examples of the base used in this invention include sodium hydroxide, potassium hydroxide, sodium methylate, sodium ethylate, potassium-t-butoxide, sodium amide, sodium hydride, potassium hydride and lithium diisopropyl amide.

Examples of the reaction solvents that are used include alcohol sovents such as methanol, ethanol and isopropanol, ether solvents such as diethyl ether, ethylene glycol dimethyl ether, diethylene glycol dimethyl ether, dioxane and tetrahydrofuran, as well as N,N-dimethyl formamide, N,N-dimethyl acetamide, dimethyl sulfoxide and N-methyl pyrrolidone.

The reaction is carried out by either simultaneously combining the benzene phosphonate ester indicated in general formula (69) with an equivalent amount of the carbonyl compound indicated in formula (70), and an equivalent or excess amount of base and solvent, and allowing to react at the specified temperature, or by first dissolving the benzene phosphonate ester indicated in formula (69) in the solvent followed by sequential addition of base and the carbonyl compound indicated in formula (70) and then allowing to react at the specified temperature.

After completion of the reaction, the styryl compound indicated in formula (68) can be obtained in high yield by transferring the product solution into a large valume of water or a saturated aqueous solution of salt, and collecting the solid which is obtained or dissolving the solid which is obtained in an arbitary organic solvent, allowing it to fractionate and then removing the organic solvent.

PREFERRED EMBODIMENTS

Figure 1:
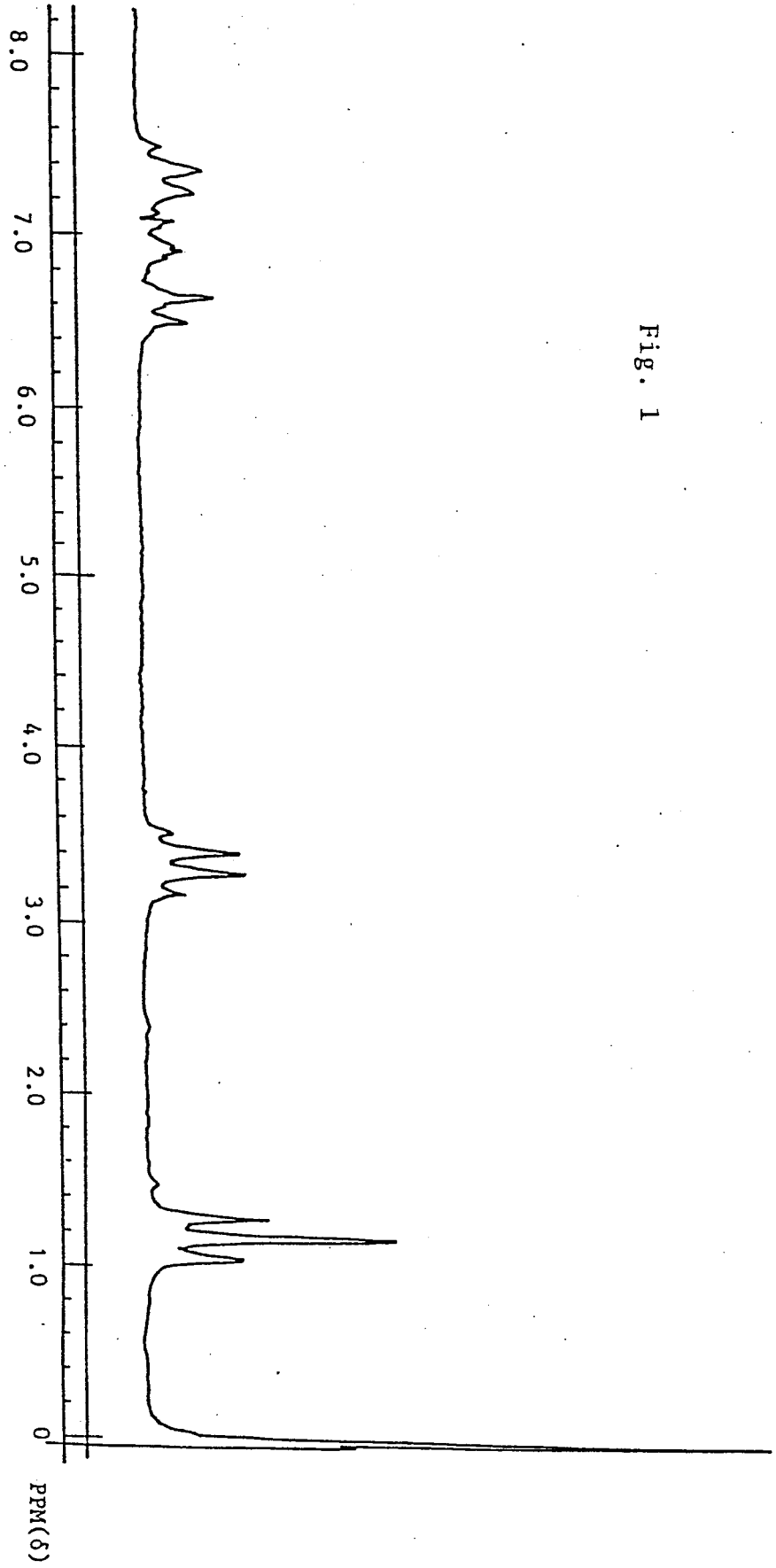
FIG. 1 shows NMR data of the compound of Synthesis Example 3.

The invention will be illustrated below in reference to synthesis of the electrotransporting compounds and the photoreceptor. Among the synthesis examples 1, 2, 3 and 4, the compounds of the synthesis examples 3 and 4 are novel. Then the compounds obtained in Examples 36 to 41 are also novel.

EXAMPLES

SYNTHESIS EXAMPLE 1

Synthesis of 1,3,5-tris(β-(p-methoxystyryl))benzene (Compound (4))

77.4 g (0.3 mol) of diethyl phosphonate prepared from p-chloromethylanisole was dissolved in 500 ml of dimethylformamide in a 2-l four-necked flask fitted with a stirrer, a cooling tube, a nitrogen inlet tube and a dropping funnel. A solution of 40 g of sodium hydroxide in 200 ml of methanol was added to the flask at room temperature. A solution of 16.2 g (0.1 mol) of 1,3,5-triformylbenzene in 400 ml of dimethylformamide was slowly added dropwise to the flask at room temperature. After the completion of the dropwise addition, the obtained mixture was stirred at room temperature for one hour and filtered to obtain a yellow crystal. This crystal was washed with water thrice and with methanol twice and recrystallized from ethanol to obtain 36 g of 1,3,5-tris(β-(p-methoxystyryl))benzene (yield : 78 %).

SYNTHESIS EXAMPLE 2

Synthesis of 1,3,5-tris(β-(p-N,N-diethylaminostyryl))benzene (Compound (6))

3 g (5.7 mmol) of diethyl phosphonate prepared from 1,3,5-tris(chloromethyl)benzene, 3 g (17 mmol) of p-N,N-diethylaminobenzaldehyde, 1.2 g of sodium hydride and 300 ml of 1,2-dimethoxyethane were fed into a 1-l four-necked flask fitted with a stirrer, a cooling tube, a nitrogen inlet tube and a thermometer. The contents were stirred at 85° C. for 3 hours, while introducing nitrogen thereinto. The reaction mixture was cooled to room temperature and poured into 2 l of water, followed by the addition of 1 l of ethyl acetate. The obtained mixture was stirred enough. The ethyl acetate layer was separated, washed with water twice, dried over anhydrous sodium sulfate and distilled under a reduced pressure to remove the ethyl acetate. Thus, a yellow solid was obtained and recrystallized from a n-hexane-ethyl acetate mixture (4 : 1) to obtain 3 g of a yellow crystal (yield : 90 %).

SYNTHESIS EXAMPLE 3

1,2,4-tris (β-(p-N,N-diethylaminostyryl))benzene (synthesis of illustrated compound (41))

5 g of diethyl phosphonate (9.5 millimoles) synthesized from 1,2,4-tris (bromomethyl) benzene, and 300 ml of ethylene glycol dimethyl ether are placed in a 1-l four-necked flask provided with a stirring device, cooling tube, nitrogen inlet tube and thermometer, and allowed to dissolve. To this is added 3.0 g of sodium hydride at room temperature. After stirring for 30 minutes, 50 ml of a ethylene glycol dimethyl ether solution of 5 g (28.5 millimoles of p-N,N-diethylaminobenzaldehyde is added dropwise at room temperature. After dropping is completed, the temperature is raised to 85° C. and the solution is then stirred for 5 hours at that temperature.

After that, the reaction mixture is allowed to cool to room temperature followed by pouring into 2l of water. In addition, 1l of ethyl acetate is added and mixed well. The ethyl acetate layer is then separated. This ethyl acetate solution is then washed twice with water and then dried with anhydrous sodium sulfate. After drying, the ethyl acetate is removed under reduced pressure to obtain a yellow solid. After purification using a silica gel column (eluent:ethyl acetate) and recrystallization from isopropanol, 4.7 g (yield: 83%) of a yellow crystal was obtained.

Melting Point: 71°-73° C. Elemental Analysis ($C_{42}H_{51}N_3$):

| | Calculated (%) | Found (%) |
|---|---|---|
| C | 84.42 | 84.31 |
| H | 8.54 | 8.50 |
| N | 7.04 | 7.19 |

In addition, NMR (60 MHz) data for this compound is shown in FIG. 1.

EXAMPLE 1

5 g of vanadyl phthalocyanine and 5 g of a butyral resin (S-LEC BM-2, a product of Sekisui Chemical Co., Ltd.) were dissolved in 90 ml of cyclohexanone. The mixture was kneaded in a ball mill for 24 hours. The obtained dispersion was applied to an aluminum plate with a bar coater so as to give a dry film thickness of 0.5 μm and dried to form a generator layer.

Then, 5 g of the tristyryl compound (4) prepared in Synthesis Example 1 and 5 g of a polycarbonate resin (Lexan 141-111, a product of Engineering Plastics Co., Ltd.) were dissolved in 90 ml of methylene chloride. The obtained solution was applied on the generator layer formed above with a blade coater so as to give a dry film thickness of 25 μm and dried to form a transport layer.

The electrophotographic photoreceptor produced above was charged with a corona voltage of −5.5 kV by the use of test equipment for electrostatic copying paper SP-428 (mfd. by Kawaguchi Denki Seisakusho, K.K.). The initial surface potential Vo was −780 V. The surface potential after allowing to stand in a dark place for seconds (hereinafter abbreviated to "$V_5$") was −760 V. The resulting photoreceptor was irradiated with a 780 nm semiconductor laser. The half decay exposure energy $E_{\frac{1}{2}}$ was 0.5 μJ/cm$^2$, while the residual potential $V_R$ was −8.5 V.

After repeating the above operation 5000 times, the Vo, $V_5$, $E_{\frac{1}{2}}$ and $V_R$ were −760 V, −740 V, 0.5 μJ/cm$^2$ and −8.4 V respectively, which reveals that the performance of the electrophotographic photoreceptor is hardly lowered by repeated operations, i.e., the photoreceptor is excellent in endurance.

EXAMPLES 2 AND 10

Photoreceptors were each produced and evaluated in a similar manner to that of Example 1 except that a compound given in Table 1 was used as a charge carrier transport material The results are shown in Table 1.

TABLE 1

| | Charge transporting agent | | Characteristics of photoreceptor | | | |
|---|---|---|---|---|---|---|
| | | | $V_0$ (V) | $V_5$ (V) | $E_{1/2}$ (μJ/cm$^2$) | $V_R$ (V) |
| Example-1 | (4) | initial | −780 | −760 | 0.5 | −8.5 |
| | | after 5000 runs | −760 | −740 | 0.5 | −8.4 |
| Example-2 | (6) | initial | −730 | −700 | 0.4 | −4.8 |
| | | after 5000 runs | −715 | −690 | 0.4 | −5.3 |
| Example-3 | (7) | initial | −680 | −660 | 0.4 | −3.8 |
| | | after 5000 runs | −690 | −660 | 0.5 | −4.2 |
| Example-4 | (11) | initial | −750 | −740 | 0.6 | −12.5 |
| | | after 5000 runs | −740 | −720 | 0.7 | −18.4 |
| Example-5 | (12) | initial | −660 | −640 | 0.4 | −3.4 |
| | | after 5000 runs | −650 | −620 | 0.5 | −5.8 |
| Example-6 | (18) | initial | −790 | −785 | 0.8 | −17.0 |
| | | after 5000 runs | −780 | −780 | 0.8 | −18.0 |
| Example-7 | (22) | initial | −720 | −685 | 0.6 | −11.4 |
| | | after 5000 runs | −705 | −690 | 0.7 | −13.5 |
| Example-8 | (38) | initial | −770 | −770 | 1.0 | −25.6 |
| | | after 5000 runs | −760 | −740 | 1.0 | −26.3 |
| Example-9 | (26) | initial | −660 | −630 | 0.5 | −6.5 |
| | | after 5000 runs | −640 | −630 | 0.5 | −6.8 |
| Example-10 | (31) | initial | −720 | −700 | 0.6 | −8.2 |
| | | after 5000 | −715 | −690 | 0.7 | −15.9 |

EXAMPLE 11

The production of a photoreceptor and the evaluation thereof were carried out in the same procedure as that of Example 1 except that the vanadyl phthalocyanine was replaced by metal-free phthalocyanine of X-type and that a tristyryl compound represented by the formula (6) was used as a charge transporting agent.

The initial surface potential Vo thereof was −730 V, while the surface potential after allowing to stand in a dark place for 5 seconds, i.e., $V_5$ was −715 V. The half decay exposure energy $E_{\frac{1}{2}}$ exhibited when the photoreceptor was irradiated with a 780 nm semiconductor laser was 0.5 μJ/cm² and the residual potential $V_4$ was −13.5 V.

The Vo, $V_5$, $E_{\frac{1}{2}}$ and $V_R$ after repeating the above operation 5000 times were −720 V, −705 V, 0.5 μJ/cm² and −15.0 V respectively, which reveals that the performance of the photoreceptor is hardly lowered by repeated operations, i.e., the photoreceptor is excellent in endurance.

COMPARATIVE EXAMPLE 1

The production of a photoreceptor and the evaluation thereof were carried out in the same manner as that of Example 1 except 1 that the tristyryl compound (4) was replaced by a hydrazone compound represented by the formula below.

The surface potential Vo and $V_5$ before exposure equivalent to those of Examples 1 to 10. However, the half decay exposure energy $E_{\frac{1}{2}}$ was high, i.e., 2.1 μJ/cm², while the residual voltage $V_R$ was high, i.e., −32 V.

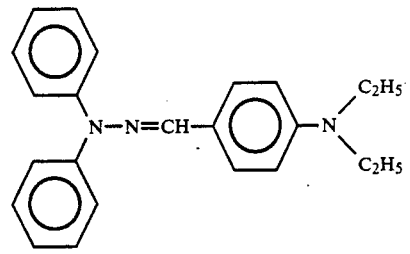

EXAMPLES 12 TO 23

Using X type metal-free phthalocyanine in place of the vanadyl phthalocyanine in Example 1, and using copolymer resin of vinyl chloride and vinyl acetate (S-LEC C, Sekisui Chemical Co., Ltd.) in Example 1, the charge generation layer was formed on an aluminum deposition polyester film. On the surface of this, a charge transfer layer consisting of the tristyryl compounds indicated in Table 2 were formed in the same manner as Example 1 followed by evaluation as photoreceptors.

The results of this evaluation are indicated in Table 2. As is clear from Table 2, these photoreceptors showed high sensitivity and high durability.

TABLE 1

| Example | Charge Transfer Material | | Photosensor Characteristics $V_0$ (V) | $V_5$ (V) | $E_{1/2}$ (μJ/cm²) | $V_R$ (V) |
|---|---|---|---|---|---|---|
| 12 | (39) | Initial | −805 | −795 | 0.41 | −14 |
| | | After 5000 Testings | −780 | −760 | 0.41 | −17 |
| 13 | (41) | Initial | −750 | −730 | 0.32 | −8 |
| | | After 5000 Testings | −740 | −720 | 0.32 | −9 |
| 14 | (42) | Initial | −760 | −730 | 0.30 | −6 |
| | | After 5000 Testings | −740 | −725 | 0.31 | −7 |
| 15 | (46) | Initial | −780 | −760 | 0.38 | −11 |
| | | After 5000 Testings | −770 | −755 | 0.39 | −13 |
| 16 | (47) | Initial | −720 | −700 | 0.29 | −7 |
| | | After 5000 Testings | −700 | −680 | 0.30 | −10 |
| 17 | (52) | Initial | −800 | −770 | 0.32 | −13 |
| | | After 5000 Testings | −780 | −750 | 0.33 | −17 |
| 18 | (54) | Initial | −780 | −740 | 0.38 | −25 |
| | | After 5000 Testings | −770 | −720 | 0.39 | −28 |
| 19 | (57) | Initial | −730 | −705 | 0.33 | −12 |
| | | After 5000 Testings | −715 | −690 | 0.33 | −13 |
| 20 | (59) | Initial | −750 | −710 | 0.28 | −5 |
| | | After 5000 Testings | −730 | −690 | 0.28 | −7 |
| 21 | (60) | Initial | −740 | −720 | 0.29 | −9 |
| | | After 5000 Testings | −730 | −700 | 0.30 | −15 |
| 22 | (64) | Initial | −720 | −680 | 0.32 | −10 |
| | | After 5000 Testings | −720 | −670 | 0.32 | −10 |
| 23 | (65) | Initial | −750 | −720 | 0.38 | −21 |
| | | After 5000 Testings | −740 | −710 | 0.39 | −25 |

COMPARATIVE EXAMPLE 2

Other than using the para-bisstyryl compound indicated in the formula below in place of the tristyryl compound of formula (4) in Example 1, the photoreceptor was manufactured in the same manner and then evaluated. Said para-bisstyryl compound showed poor solubility in solvent resulting in the charge transfer layer being unable to be adequately formed.

In addition, the initial values of $V_0$, $V_5$, $E_{\frac{1}{2}}$ and $V_4$ were −570 V, −520 V, 063 μJ/cm² and −21 V, respectively. These results indicate both inferior sensitivity and durability.

EXAMPLES 24 TO 34

The beforehand shown compounds 38, 39, 42, 65, 66, 59, 47, 58, 43, 57 and 67 were produced in the same way as shown in Synthesis Example 3, except for using corresponding carbonyl compounds in place of P-N,N-dimethylaminobenzaldehyde. Results about production yields and analysis data are shown in Table 3.

SYNTHESIS EXAMPLE 4

1,2,4-tris (β-(2-pyridyl vinyl)) benzene (synthesis of illustrated compound (61)

5g (9.5 millimoles) of diethyl phosphonate synthesized from 1,2,4-tris (bromomethyl) benzene, 4.4 g (28.5 millimoles) of 2-formyl pyridine, 500 ml of dimethyl formamide, and 7 ml of a 28% methanol solution of sodium methoxide were mixed in the same apparatus as that used in Synthesis Example 3. The mixture was stirred for 6 hours at 40° C. In the same way as in Synthesis Example 3, the reaction mixture was purified using a silica gel column (eluent:ethyl acetate) and then recrystallized from toluene to obtain 3.25 g (yield: 88.4%) of a yellow crystal.

Melting Point: 134°–136° C.

Elemental Analysis ($C_{27}H_{21}N_3$)

| | Calculated (%) | Found (%) |
|---|---|---|
| C | 83.72 | 83.62 |
| H | 5.43 | 5.61 |
| N | 10.85 | 10.77 |

EXAMPLES 36 TO 41

The beforehand shown compounds 37, 40, 60, 62, 55, 52 and 49 were produced in the same way as shown in Synthesis Example 4, except for using corresponding respective carbonyl compounds in place of p-N,N-dimethyl aminobenzaldehyde. Results about production yields and analysis data are shown in Table 4.

TABLE 3

| Example | Illus. Comp. | Yield (%) | Melting Pt.(°C.) | | Elemental Analysis (%) C | H | N | O |
|---|---|---|---|---|---|---|---|---|
| 24 | 38 | 91 | 111–111.5 | Calcd. | 92.96 | 7.04 | — | — |
| | | | | Found | 92.81 | 7.19 | — | — |
| 25 | 39 | 73 | 107–108 | Calcd. | 83.54 | 6.33 | — | 10.13 |
| | | | | Found | 83.38 | 6.37 | — | 10.25 |
| 26 | 42 | 85 | 88–89 | Calcd. | 89.49 | 5.76 | 4.75 | — |
| | | | | Found | 89.59 | 5.71 | 4.70 | — |
| 27 | 65 | 88 | 125–126 | Calcd. | 87.55 | 6.44 | 6.01 | — |
| | | | | Found | 87.68 | 6.24 | 6.08 | — |
| 28 | 66 | 83 | 121–122.5 | Calcd | 87.45 | 6.83 | 5.67 | — |
| | | | | Found | 87.42 | 6.77 | 5.81 | — |
| 29 | 59 | 84 | 105–106 | Calcd. | 86.88 | 6.79 | 6.33 | — |
| | | | | Found | 86.71 | 6.77 | 6.42 | — |
| 30 | 47 | 77 | 87.87.5 | Calcd. | 85.28 | 7.61 | 7.11 | — |
| | | | | Found | 85.41 | 7.59 | 7.00 | — |
| 31 | 58 | 63 | 173–175 | Calcd. | 88.16 | 6.12 | 5.72 | — |
| | | | | Found | 87.98 | 6.08 | 5.94 | — |
| 32 | 43 | 81 | 107–108 | Calcd. | 92.96 | 7.04 | — | — |
| | | | | Found | 93.03 | 6.97 | — | — |
| 33 | 57 | 88 | 76–77.5 | Calcd. | 84.32 | 8.11 | 7.57 | — |
| | | | | Found | 84.39 | 8.17 | 7.44 | — |
| 34 | 67 | 87 | 84.5–85.5 | Calcd. | 89.32 | 6.15 | 4.53 | — |
| | | | | Found | 89.17 | 6.22 | 4.61 | — |

TABLE 4

| Example | Illus. Comp. | Yield (%) | Melting Pt.(°C.) | | Elemental Analysis (%) C | H | N | O |
|---|---|---|---|---|---|---|---|---|
| 36 | 37 | 91 | 120.5–121 | Calcd. | 93.75 | 6.25 | — | — |
| | | | | Found | 93.72 | 6.28 | — | — |
| 37 | 40 | 83 | 79–80 | Calcd. | 84.21 | 7.60 | 8.19 | — |
| | | | | Found | 84.01 | 7.66 | 8.33 | — |
| 38 | 60 | 88 | 121–123 | Calcd. | 88.56 | 6.27 | 5.17 | — |
| | | | | Found | 88.59 | 6.13 | 5.14 | — |
| 39 | 62 | 83 | 125.5–126.5 | Calcd. | 93.51 | 6.49 | — | — |
| | | | | Found | 93.56 | 6.34 | — | — |
| 40 | 55 | 74 | 164–165.5 | Calcd. | 94.12 | 5.88 | — | — |
| | | | | Found | 93.98 | 6.02 | — | — |
| 41 | 52 | 72 | 62.5–64 | Calcd. | 84.51 | 8.92 | 6.57 | — |
| | | | | Found | 84.59 | 8.80 | 6.61 | — |
| 42 | 49 | 92 | 173–175 | Calcd. | 95.05 | 4.95 | — | — |
| | | | | Found | 95.21 | 4.79 | — | — |

the invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

We claim:

1. A photoreceptor member for use in electrophotography, which comprises (a) and electrically conductive substrate, (b) an electric charge carrier generation layer and (c) an electric charge carrier transport layer, said transport layer containing therein an electric charge carrier transport compound having the formula (1):

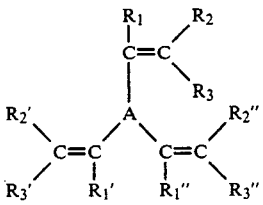

(1)

in which $R_1$, $R_1'$ and $R_1''$ each are hydrogen, a linear or branched alkyl, a linear or branched alkyl having a substituent(s), an aryl or an aryl having a substituent(s), $R_2$, $R_3$, $R_2'$, $R_3'$, $R_2''$ and $R_3''$ each are hydrogen, a linear or branched alkyl, a linear or branched alkyl having a substituent(s), an aryl, an aryl having a substituent(s), an alkenyl, an alkenyl having a substituents(s), a heterocyclic ring or a heterocyclic ring having a substituent(s), $R_2$ and $R_3$ may form a ring with their adjacent carbon, $R_2'$ and $R_3'$ may form a ring with their adjacent carbon and $R_2''$ and $R_3''$ may form a ring with their adjacent carbon, A being a trivalent, aromatic hydrocarbon group.

2. The photoreceptor as in claim 1, in which said trivalent group for A is selected from at least one member of the group consisting of:

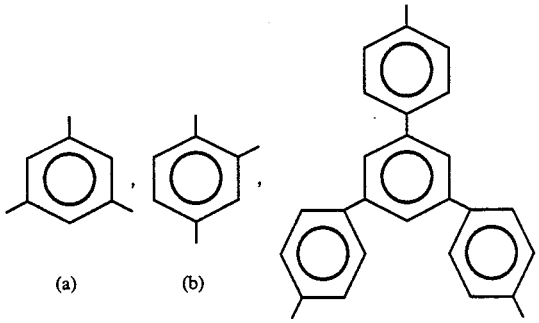

(a) (b) (c)

(d) naphthalene, (e) anthrathene, (f) phenanthrene, (g) pyrene, (h) naphthathene, (i) 1,2-benzoanthrathene, (j) 3,4-benzophenanthrene, (k) chrysene and (l) triphenylene.

3. The photoreceptor as in claim 2, in which said trivalent group for A is selected from at least one member of the group consisting of (a) and (b).

4. The photoreceptor as in claim 1, in which $R_1$, $R_1'$ and $R_1''$ each are hydrogen, an alkyl having from 1 to 6 carbon atoms, phenyl or naphthyl; and $R_2$, $R_2'$, $R_2''$, $R_3$, $R_3'$ and $R_3''$ each are hydrogen, an alkyl having from 1 to 12 carbon atoms, phenyl, naphthyl or styryl; or $R_2$, $R_3$, $R_2'$ and/or $R_2''$ and $R_3''$ may form a ring having from 4 to 12 carbon atoms.

* * * * *